US010167670B2

(12) United States Patent
Guidera

(10) Patent No.: US 10,167,670 B2
(45) Date of Patent: Jan. 1, 2019

(54) MOVABLE LADDER PLATFORM SYSTEM AND METHOD

(71) Applicant: David Guidera, Scottsdale, AZ (US)

(72) Inventor: David Guidera, Scottsdale, AZ (US)

( * ) Notice: Subject to any disclaimer, the term of this patent is extended or adjusted under 35 U.S.C. 154(b) by 175 days.

(21) Appl. No.: 15/213,376

(22) Filed: Jul. 18, 2016

(65) Prior Publication Data

US 2017/0044828 A1 Feb. 16, 2017

Related U.S. Application Data

(60) Provisional application No. 62/193,157, filed on Jul. 16, 2015.

(51) Int. Cl.
*E06C 7/16* (2006.01)
*E06C 7/14* (2006.01)
*E06C 7/12* (2006.01)

(52) U.S. Cl.
CPC ..... *E06C 7/16* (2013.01); *E06C 7/14* (2013.01); *E06C 7/12* (2013.01)

(58) Field of Classification Search
CPC ..... E06C 7/14; E06C 7/16
See application file for complete search history.

(56) References Cited

U.S. PATENT DOCUMENTS 656,946 A * 8/1900 Corduan ..... E06C 1/39 182/106
929,291 A * 7/1909 Dawkins ..... E06C 7/16 248/238
1,213,622 A * 1/1917 Gidlof ..... E06C 7/14 248/210
1,238,286 A * 8/1917 Gross ..... E06C 7/14 248/210
2,656,223 A * 10/1953 Gray ..... E04G 1/151 182/119
2,778,595 A * 1/1957 Mastin ..... E06C 7/16 182/119
4,800,988 A * 1/1989 Dunmore ..... E06C 7/08 182/103
5,120,013 A * 6/1992 Sweeney ..... E06C 7/14 182/116
5,544,718 A * 8/1996 Schumacher ..... E06C 7/14 182/129
5,584,357 A * 12/1996 Gugel ..... B25H 3/06 182/129
6,145,620 A * 11/2000 Strunk ..... E06C 1/39 182/107
6,286,624 B1 * 9/2001 Bowles ..... E04G 1/30 182/117

(Continued)

FOREIGN PATENT DOCUMENTS

WO WO-2008041156 A2 * 4/2008 ..... E06C 1/393

*Primary Examiner* — Colleen M Chavchavadze
(74) *Attorney, Agent, or Firm* — Skaar Ulbrich Macari, P.A.

(57) ABSTRACT

An adjustable platform system configured in or attached to a ladder having a moveable or adjustable platform assembly operatively coupled thereto. An adjustment mechanism is operatively connected to the first and second arm members and the platform member, whereby the platform member is selectively movable along a length of the ladder legs or the first and second arm members via the adjustment mechanism.

15 Claims, 3 Drawing Sheets

(56) References Cited

U.S. PATENT DOCUMENTS

| | | | | |
|---|---|---|---|---|
| 8,011,473 | B1 * | 9/2011 | Gregersen | E06C 7/16 182/101 |
| 9,410,374 | B2 * | 8/2016 | Shanks | E06C 1/397 |
| 2007/0039780 | A1 * | 2/2007 | Vergote | E04G 1/30 182/129 |
| 2015/0014094 | A1 * | 1/2015 | Brooks | E04G 5/003 182/129 |

* cited by examiner

MOVABLE LADDER PLATFORM SYSTEM AND METHOD

PRIORITY

This Application claims priority to and the benefit of US Provisional Patent Application No. 62/193,157, filed Jul. 16, 2015, which is incorporated fully herein by reference.

FIELD

The present invention relates generally to work platform systems and, more particularly, to movable and adjustable platform systems and devices for a ladder, such as a stepladder.

BACKGROUND

Working on ladders, including stepladders, can be difficult because it often means the user doesn't have ready or convenient access to tools and materials generally placed on the ground below the ladder. It is even more inconvenient, and dangerous, when users attempt to use various tools and material while on the ladder. Namely, users must balance themselves on the ladder while attempting to hold, manipulate, or otherwise use the items.

While stepladders have a top platform, it does not provide much assistance with holding tools and material. When a user is on the top steps of the ladder, they have to lean over to access the platform. As the user moves down the ladder, they then have to climb up and reach over the top step to access the platform. When at the bottom of the ladder, they have to go back up the ladder to reach the platform.

Various conventional devices attempting to address these existing issues have included a ladder incorporating a vertical shelf. The shelf is adapted to transport cargo. Another device includes a stepladder shelf having a plurality of brackets for positioning the shelf along the ladder. However, the user has to either place the work item on the floor or hold the item in their hands to move the shelf to the desired height and location for use.

These modifications to date have failed to properly and efficiently address the problems innately present with working on stepladder. As such, there exists a need for a system and device that can act as a platform that selectively moves along the height or length of the ladder for improved utility and safety.

SUMMARY

The object of the present invention is to provide an adjustable ladder platform that assists contractors and homeowners alike when using a ladder. Utilizing current ladder platforms can be difficult and dangerous as users must lean over the top of the ladder to reach the platform. The present invention allows the user to have a platform that moves along with them as they move up or down the ladder.

The present invention provides an adjustable work platform system that moves up or down a ladder, such as a stepladder, as the user needs it. This selectively movable platform system can be attached to, or built into, the legs of the ladder such that the platform travels along a side of the ladder and is reachable by a user positioned anywhere on the ladder. The movement of the platform along a side of the ladder eliminates the need for a user to bend over the top of a ladder to access the platform and does not inhibit a users ability to move up and down the ladder steps or rungs. In an example embodiment, the system has two arms that may be attached at the top with a hinge. The length of the arms will depend upon the length of the stepladder. The arms are either attached to the ladder legs via a fastener or built into the ladder.

The system includes an adjustable platform assembly that travels long the arms. An adjustment mechanism such as a linear ratchet mechanism may operatively couple the arms or legs of the ladder to the adjustable platform. The adjustment mechanism permits a user to select the position of the platform along the length of the ladder. The platform may have an adjustable length that permits it to get generally narrower as the platform moves toward a top or apex of the ladder and generally wider as the platform moves toward the feet of a ladder. This may be accomplished by having nestable projections or tines extending between support portions such that the nestable projections move relative to each other as the support portions travel along a length of the ladder.

A removable tray can be provided that is adapted to rest on or be removably coupled to the platform. The tray may have a shape or configuration that permits the support portions to move relative to the tray as they travel along the ladder or arms. For example, the support portions may slide relative to the tray as they move along the length of the ladder. The tray may also include channels or similar structure that is capable of receiving a portion of the support portions, whereby the support portions can move in the channel or channels as they travel along the arms or the legs of the ladder.

Figure 1A:
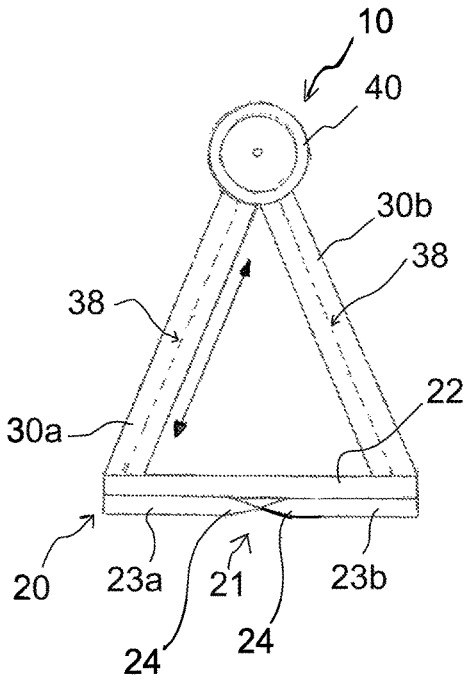
FIG. 1*a* depicts a front view of a movable work platform system, in accordance with embodiments of the invention.

The accompanying drawings, which are incorporated herein and form part of the specification, illustrate various embodiments of the present disclosure and, together with the description, further explain the principles of the disclosure and to enable a person skilled in the pertinent art to make and use the embodiments disclosed herein. In the drawings, like reference numbers indicate identical or functionally similar elements. The drawings are not drawn to scale, may be exaggerated to illustrate various aspects of the present disclosure, and should not be construed as limiting the design features.

DETAILED DESCRIPTION

Figure 1B:
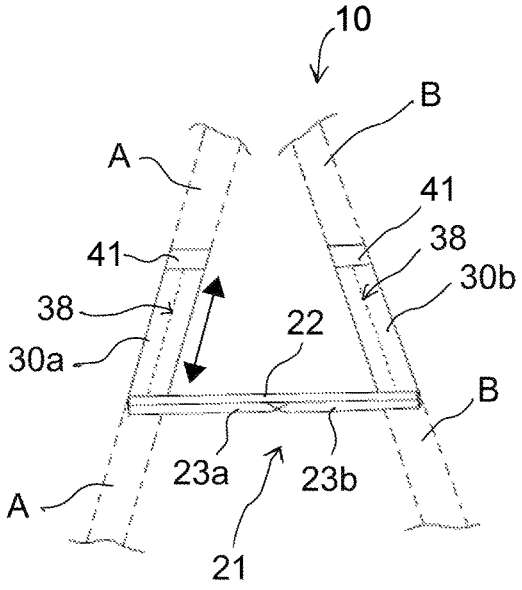
FIG. 1*b* depicts a front view of a movable work platform, and partial side view of a ladder, in accordance with embodiments of the invention.

Referring now to FIGS. 1*a* and 1*b*, there are illustrative renderings of the work platform system 10 of the present invention. The work platform system 10 comprises a movable platform assembly 20 for use on or with a ladder (e.g., stepladder) having at least one leg A, B and rungs or steps (not shown). The system 10 may be coupled to a leg or legs A, B (illustrated with dashed lines in FIG. 1*a*) of the ladder and to selectively position a platform between a top and bottom of the ladder. The system 10 permits a user to move the platform along a length of a ladder in order to coincide with movement or positioning of a user on the ladder. This selectively movable platform system 10 can be attached to, or built into, the legs of the ladder such that the platform extends out from and travels along a side of the ladder and is reachable by a user positioned anywhere on the ladder. The movement of the platform 20 along a side of the ladder eliminates the need for a user to bend over the top of a ladder to access the platform and does not inhibit a user's ability to move up and down the ladder steps or rungs. In another embodiment, the system 10 and platform can be mounted on a side, face or back surface of a leg of an extension ladder to permit a user to have an adjustable platform on an extension ladder.

In one example embodiment, the platform assembly 20 is designed to be operatively coupled with one or more arms 30*a*, 30*b* that can be coupled to legs of the ladder. The arms 30*a*, 30*b* can act as tracks for movement of the platform assembly 20 along a length of the arms 30*a*, 30*b*. As discussed in more detail below, the arms 30*a*, 30*b* of the system 10 may be coupled or connected to an existing ladder by overlapping the arm 30*a*, 30*b* with the legs of the ladder and securing them thereto via a coupling mechanism or fasteners 36 (e.g., hex nuts and the like). In another example embodiment, as discussed below, the system 10 can be made integral with a ladder during a manufacturing process.

Figure 2:
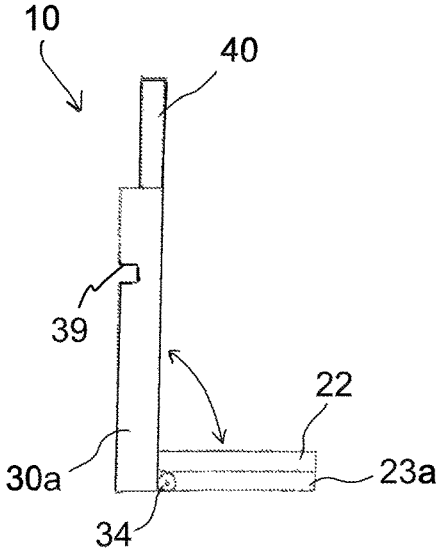
FIG. 2 depicts a side view of the system illustrating an arm and movable platform assembly, in accordance with embodiments of the invention.

Continuing with FIG. 1*a*, the platform assembly 20 can include an adjustable support 21 for supporting a tray 22 or other objects. In one example embodiment, the support 21 may have a first support portion 23*a* and a second support portion 23*b* operatively coupled to respective arms 30*a*, 30*b*. As illustrated in FIG. 2, each support portion (23*a* only being shown for illustration purposes) may extend away from arms 30*a*, 30*b* in a generally transverse orientation. Other angular orientations between the arms 30*a*, 30*b* and the support portions 23*a*, 23*b* are also contemplated and may depend upon an angle of a ladder to a surface.

Figure 3:
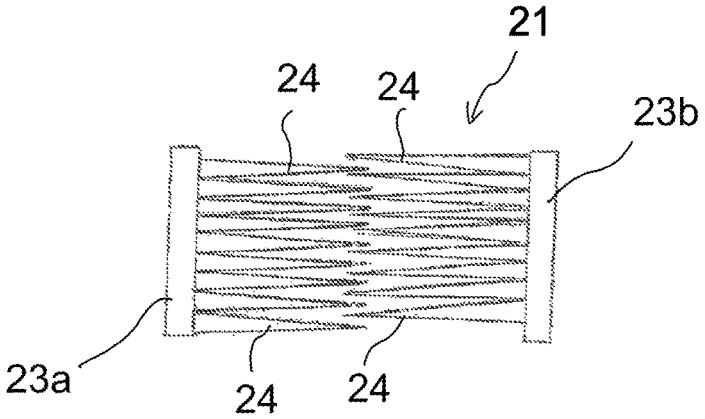
FIG. 3 depicts a partial view of support portions of the platform assembly having mateable portions, in accordance with embodiments of the invention.
Figure 5:
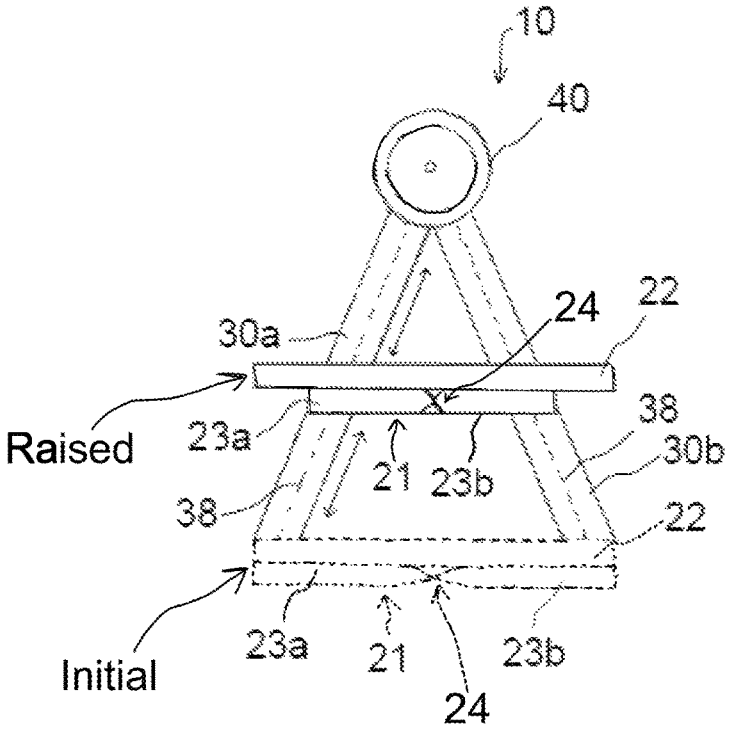
FIG. 5 depicts a front view of a movable work platform in an alternate position on the ladder legs or device arms, in accordance with embodiments of the invention.

Turning to FIG. 3, each support portion 23*a*, 23*b* may include projections, teeth, tines, telescoping or nesting structures or other mating structures or features 24 capable of defining an adjustable zone or region for adjusting an overall length of support 21 and, optionally, supporting the tray 22 or other objects. In one embodiment, the projections 24 may extend from the support portions 23*a*, 23*b* toward the opposite or opposed support portion 23*a*, 23*b*. The orientation of the projections 24 creates an adjustable surface for lengthening or shortening an overall length of the support 21. In one example embodiment, the projections or tines 24 may be generally staggered along a length and/or depth of each support portion 23*a* and 23*b* such that the projections 24 are capable of movably meshing, mating or overlapping with each other as the support portions 23*a*, 23*b* move along a length of the arms 30*a*, 30*b*. For example, as illustrated in FIG. 5, the projections 24 may mesh or mate together as the support portions 23*a*, 23*b* move closer together (e.g., as they travel toward a cap of the ladder). As illustrated in FIG. 1*a*, the projections 24 may also un-mesh or un-mate as the support portions 23*a*, 23*b* move further apart (e.g., as they move toward the feet of a ladder). The support portions 23*a*, 23*b* and projections 24 may be manufactured from any material and configuration that permits them to be able to support the tray 22 and other objects, such as paint cans, tools and other objects needed by a user on a ladder.

Referring back to FIG. 2, the support portions 23*a*, 23*b* are illustrated as having a width (e.g., distance extending transversely away from the arms 30*a*, 30*b*). This width is depicted as being generally equal to a width of the tray 22. The support portions 23*a*, 23*b* may, however, have varying widths and configurations. For example, the support portions 23*a*, 23*b* may be selectively adjustable or telescoping along their widths by having telescopic or nesting portions. The widths may be adjusted by a user manipulating one or more pins, lever-pin mechanisms or similar structures and moving the support portions 23*a*, 23*b* toward or away from the legs of the ladder A, B. The support 21 may also have structures that permit it to be used without a tray 22. For example, the support portions 23*a*, 23*b* may include hooks, apertures and other structures formed in or attached thereto to hang or support objects such as paint cans and tools.

The tray 22 has an upper surface capable of supporting objects. In one example embodiment, the upper surface of the tray 22 may include a lip, ledge or wall capable of retaining objects on the tray. The upper surface of the tray 22 may also include recesses or depressions formed therein that are adapted to hold or retain objects placed on the tray 22. The tray 22 may also have other retaining features such as, but not limited to, rubber coatings, removably coupled containers, hooks and apertures formed therein. It is also contemplated that trays having various configurations can be provided for different tasks and may be removably coupled to the platform assembly 20.

The tray 22 also has a generally lower second surface that may be capable of contacting, engaging or operatively mating with support portions 23*a*, 23*b*. In one example embodiment the tray 22 rests upon the support portions 23*a*, 23*b*. The tray 22 may also be operatively coupled to the support portions 23*a*, 23*b* to aid in preventing the tray from falling from the support portions 23*a*, 23*b*. The tray 22 and support portions 23*a*, 23*b* may be operatively coupled together in a variety of configurations, including but not limited to having channels running along at least a portion of the lower surface of the tray 22 to receive pins or bosses extending away from an upper surface of the support portions 23*a*, 23*b*. The pins or bosses may move or travel along or within the channel(s) as the support portions 23*a*, 23*b* move relative to each other as they travel along a length of the ladder. The pins or bosses may be configured to keep the tray 22 coupled to the support portions 23*a*, 23*b* until a user uncouples the tray 22. It is also contemplated that the tray 22 may be of a strong construction thereby eliminating the need for the projections 24.

Referring again to FIG. 2, the tray assembly 20 may be foldable with respect to the ladder or arms 30*a*, 30*b* when not in use or during storage of the ladder. In one embodiment, the support portions 23*a*, 23*b* may have one or more hinges 34 that permits them to fold toward or away from the ladder or arms 30*a*, 30*b*. Any hinge capable of providing support and folding functionality may be used. The support portions 23*a*, 23*b* may also be hinged or pivoted during folding of the ladder legs. In one example embodiment, when the legs A, B of the ladder are brought together or closed the projections 24 may mate, pivot up, pivot down or pivot in opposed directions in order to permit or enable complete closure of the ladder legs.

Figure 4A:
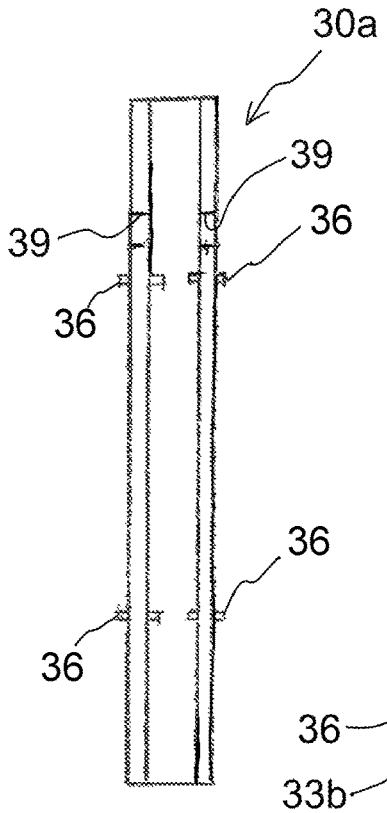
FIG. 4*a* depicts an example of an arm having fasteners for coupling to a ladder, in accordance with embodiments of the invention.
Figure 4B:
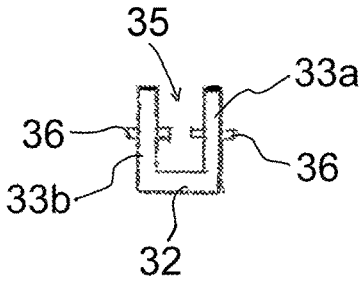
FIG. 4*b* depicts an end view of the arm of FIG. 4*a* showing fasteners, in accordance with embodiments of the invention.

As illustrated in FIG. 4*a*, the arms 30*a*, 30*b* may have a generally u-shape construct to permit them to be removably coupled to the ladder legs A, B. Other shapes and configurations are also contemplated herein. As illustrated in FIG. 4*b*, the arms 30*a*, 30*b* can have a back wall 32 and at least two generally transverse walls 33*a*, 33*b* defining a channel 35. The arms 30*a*, 30*b* can be placed over an outer surface of a ladder leg A, B such that the walls 33*a*, 33*b* shroud or cover at least a portion of the ladder legs. Once the arms 30*a*, 30*b* are positioned over the legs of the ladder they can be coupled or removably fixed to the ladder by a fastener 36 such as a bolt, bolt and nut combination, pins, etc. The arms 30*a*, 30*b* can be any length including the entire length of a ladder to which they are attached. In another embodiment, the arms 30*a*, 30*b* may have a length covering approximately 30 percent of the length of a ladder.

In one embodiment, the arms 30*a*, 30*b* may be operatively coupled together by a hinge, pivot point, adjustment mechanism 40, as illustrated in FIG. 1*a*. The hinge 40 may be adapted to permit ends of the arms 30*a*, 30*b* operatively coupled thereto to rotate around a radius of the hinge 40 in order to permit the arms 30*a*, 30*b* to move relative to each other for positioning on or over the legs of a ladder during movement of the system 10. Portions of the arms 30*a*, 30*b* coupled to the hinge 40 may move adjustably away from or toward hinge 40 to compensate for movement of the system 10 up and down the ladder. In another embodiment, as illustrated in FIG. 1*b*, the arms 30*a*, 30*b* can be coupled to the legs of a ladder A, B without the use of hinge or hinging mechanism coupling the arms 30*a*, 30*b* together as illustrated in the example embodiment of FIG. 1*a*. However, it is also contemplated that each arm 30*a*, 30*b* may each include an adjustment or ratcheting housing 41 that may be in operable communication with adjustment mechanism 38.

Referring again to FIG. 2, at least one or more lower pivot points may operatively couple the arms 30*a*, 30*b* to the platform assembly 20 in order to permit adjustment of each support portion 23*a*, 23*b*. The pivot points may be spring loaded or have a similar functionality to compensate for movement of the system 10 along the ladder legs A, B. The lower pivot point(s) may comprise any construct that permits adjustment of the platform 20 or support portions 23*a*, 23*b* relative to the arms 30*a*, 30*b* or legs A, B.

Continuing with FIG. 2, each of the arms 30*a*, 30*b* may include a notch 39 extending therein for receiving a support bar. The support bar may be removably inserted into and extend between the notches 39 to support objects such as hanging paint cans, tools and the like. The notches 39 may have a particular shape or retaining mechanism to retain and prevent the accidental removal of the support bar from the notches 39. Retaining mechanisms may include pins, latches, hooks and the like.

Turning back to FIG. 1*a*, the work platform system 10 includes a platform adjustment mechanism 38 operatively coupling the arms 30*a*, 30*b* and platform assembly 20 together in order to permit movement of the platform assembly 20 along a length of the ladder or the arms 30*a*, 30*b*. In one embodiment, the adjustment mechanism 38 may be a ratcheting mechanism such as, for example, a linear ratchet mechanism, ratchet and pawl, tooth and chain or belt, pins, spring-loaded pins, locking apertures, snap connectors, captive bolt or locking member, and the like. In other embodiments, the adjustment mechanism 38 may be operated by one or more handles, pins or latches operatively coupled to the platform assembly 20 or the arms 30*a*, 30*b*. It is also contemplated that the adjustment mechanism 38 may be operated by an electrical system and can be operated by remote mechanisms. In another example embodiment, the adjustment mechanism 38 includes or is operatively coupled with hinge 40.

As also previously discussed, the work platform system 10 may be included during the manufacturing process of any ladder. In this embodiment, the legs of the ladder may include a platform adjustment mechanism built into or fixed to an outer surface of the ladder legs. Adjustment mechanism similar to those previously discussed may also be utilizes on this example embodiment.

In use, as illustrated in FIG. 5, the arms 30*a*, 30*b* of the work platform system 10 are coupled to the legs of a ladder. Once the arms 30*a*, 30*b* are coupled the support portions 23*a*, 23*b* may be folded down to expose the support surface. The tray 22, if not already present, may be placed on or coupled to the support portions 23*a*, 23*b*. A user may then adjust the position of the tray 22 by raising or lowering the support portions 23*a*, 23*b* along a length of the arms 30*a*, 30*b* or the ladder. As particularly illustrated in FIG. 5, as the support portions 23*a*, 23*b* travel up the arms 30*a*, 30*b* or ladder legs from an initial position (illustrated in dashed lines) they are generally brought closer together as they approached a raised position a result of the narrowing distance between arms 30*a*, 30*b* toward the cap of the ladder. As a result, the projections 24 mesh or nest together thereby decreasing a length of the surface created by the support portions 23*a*, 23*b* and the projections 24. As the support portions 23*a*, 23*b* are moved down the ladder they are generally drawn further apart. As a result, the projections 24 moves away from each other thereby increasing an overall length of the support surface created by the support portions 23*a*, 23*b* and the projections 24. Again, as particularly illustrated in FIG. 5, during the movement of the support portions 23*a*, 23*b* the surface area of the tray 22 does not change and items contained on its surface are not disturbed. Once a particular project is completed, the support portions 23*a*, 23*b* may be folded up or down and the ladder stored.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

Several characteristics and advantages have been set forth in the preceding description, including various alternatives, together with details of the structure and function of the devices, components, and/or systems. The disclosure is intended as illustrative only and as such is not intended to be exhaustive or limiting. It will be evident to those skilled in the art that various modifications may be made, especially in matters of structure, materials, elements, components, shapes, sizes, and arrangements of parts including combinations within the principles described herein, to the full extent indicated by the broad, general meaning of the terms in which the appended claims are expressed. To the extent that these various modifications depart from the spirit and scope of the appended claims, they are intended to be encompassed therein. All references, publications, and patents referred to herein, including the figures and drawings included therewith, are incorporated by reference in their entirety.

What is claimed is:

1. A movable ladder platform device, comprising:

first and second arm members capable of being coupled to respective first and second longitudinal leg members of a ladder, with the first and second leg members together defining an A-shaped side configuration for the ladder;

at least one platform having a tray spanning between, and extending out transverse from the A-shaped side configuration of, the first and second leg members of the ladder; and an adjustment mechanism operably connected to the first and second arm members and the at least one platform, whereby the at least one platform is selectively movable along a length of the first and second arm members via the adjustment mechanism.

2. The device of claim 1, wherein the at least one platform includes a bottom platform member having movably mateable tines to enable adjustment in a length of the bottom platform member.

3. The device of claim 1, wherein the first and second arm members include one or more fasteners for attachment to the respective first and second leg members.

4. The device of claim 1, wherein the at least one platform is pivotable with respect to the first and second arm members.

5. The device of claim 1, wherein the at least one platform includes a top and bottom platform member.

6. The device of claim 1, wherein the first and second arms are retrofittingly capable of being coupled to the respective first and second leg members.

7. The device of claim 1, wherein the ladder is a stepladder.

8. A movable ladder platform system, comprising:

a ladder including at least first and second longitudinal leg members extending angularly inward toward one another along a first side of the ladder;

a movable platform device having first and second arm members attached to the respective first and second leg members; and at least one platform member operably connected to the first and second arm members, spanning between and extending out transverse from the first and second longitudinal leg members, such that the at least one platform member is selectively movable and secured along a length of the first and second arm members along the first side of the ladder.

9. The device of claim 8, wherein the at least one platform member includes a bottom platform member having movably mateable tines to enable adjustment in a length of the bottom platform member.

10. The device of claim 8, wherein the first and second arm members include one or more fasteners for attachment to the respective first and second leg members.

11. The device of claim 8, wherein the at least one platform is pivotable with respect to the first and second arm members.

12. A movable ladder platform device, comprising:

first and second arm members capable of being coupled with respective first and second angled leg members of a first A-shaped side of a ladder; and at least one platform member operably connected to the first and second arm members such that the at least one platform member spans between and extends transversely from the first and second angled leg members, at the first A-shaped side of the ladder, and is selectively movable and secured along a length of the first and second arm members.

13. The device of claim 12, wherein the at least one platform member includes a platform member portion having movably mateable tines to enable adjustment in a length of the bottom platform member.

14. The device of claim 12, wherein the first and second arm members include one or more fasteners for attachment to the respective first and second leg members.

15. The device of claim 12, wherein the at least one platform is pivotable with respect to the first and second arm members.

* * * * *